US005482911A

United States Patent [19]

Hiroishi et al.

[11] Patent Number: 5,482,911

[45] Date of Patent: Jan. 9, 1996

[54] THERMOSENSITIVE RECORDING MATERIAL

[75] Inventors: Katsunori Hiroishi, Numazu; Norio Kurisu, Susono; Hideo Aihara, Numazu, all of Japan

[73] Assignee: Ricoh Company, Ltd., Tokyo, Japan

[21] Appl. No.: 309,464

[22] Filed: Sep. 21, 1994

[51] Int. Cl.[6] ..... B41M 5/40

[52] U.S. Cl. ..... 503/200; 503/226

[58] Field of Search ..... 427/150; 503/200, 503/226; 428/211, 537.5

[56] References Cited

U.S. PATENT DOCUMENTS 4,996,182 2/1991 Matsui et al. ..... 503/200
5,037,696 8/1991 Miyake et al. ..... 428/336
5,198,407 3/1993 Motegi et al. ..... 503/226

*Primary Examiner*—B. Hamilton Hess
*Attorney, Agent, or Firm*—Oblon, Spivak, McClelland, Maier & Neustadt

[57] ABSTRACT

A thermosensitive recording material having a support and a thermosensitive coloring layer formed on the support, capable of inducing color development by the application of heat thereto is disclosed, the stiffness of the thermosensitive recording material in the lengthwise direction thereof in accordance with JIS-P-8125 being less than 0.45 $\exp^{0.018x}$ (gf·cm) wherein x represents the thickness (μm) of the recording material measured in accordance with JIS-P-8118, provided that the lengthwise direction of the recording material is (i) a machine direction in which cellulose fiber contained in a natural material for use in the support is oriented, or (ii) a plane direction of the recording material when a synthetic material is used for the support.

3 Claims, No Drawings

THERMOSENSITIVE RECORDING MATERIAL

BACKGROUND OF THE INVENTION

1. Field of the Invention

The present invention relates to a thermosensitive recording material which causes color development by the application of heat thereto, thereby forming images thereon.

2. Discussion of Background

Conventionally, a thermosensitive recording material is prepared by forming a thermosensitive coloring layer on a support such as a sheet of paper or synthetic paper, or a plastic film. The thermosensitive coloring layer comprises as the main component a thermosensitive coloring composition, so that the thermosensitive recording material is capable of producing a colored image by the application of heat thereto using a thermal head, thermal pen, laser beam, or stroboscopic lamp.

This type of thermosensitive recording material has wide-scale utilization, not only as a recording material for copying books and documents, but also as a recording material for use with printers for electronic calculators, facsimile machines, ticket vendors, and label recorders because of the following advantages over other conventional recording materials:

(1) image recording can be speedily performed, using a comparatively simple device without complicated steps for development and image fixing;

(2) the thermosensitive recording material can be produced and used without generating noise and causing environmental pollution; and (3) the manufacturing cost of the thermosensitive recording material is low.

The thermosensitive coloring composition for use in the thermosensitive recording material comprises a coloring agent and a color developer capable of inducing color formation in the coloring agent upon application of heat thereto. Conventionally, colorless or light-colored leuco dyes having a lactone, lactam, or spiropyran ring, are employed as the coloring agents; and organic acids and phenolic materials are employed as the color developers. This kind of thermosensitive recording material comprising the aforementioned leuco dye and color developer in combination is widely utilized because the color tone of the obtained images is clear, the whiteness degree of the background of the thermosensitive recording material is high, and the obtained images have excellent weather-resistance.

Recently, the demand for a relatively thick thermosensitive recording material has greatly expanded because this kind of thick thermosensitive recording material has been applied to a tag, ticket, card or price tag.

In a conventional recording apparatus used for the thermosensitive recording material, images are formed on the thermosensitive recording material while the recording material is transported by a platen roller, with the recording material being caused to closely adhere to a thermal head by the application of pressure to the recording material toward the thermal head using pressure-application means such as a spring.

To improve the adhesion between the thermosensitive recording material and the thermal head, the thermosensitive recording material is required to have a proper surface smoothness and flexibility. The adhesion of the thermosensitive recording material to the thermal head is improved by increasing the surface smoothness of the recording material, as disclosed in Japanese Patent Publication 52-20142 and Japanese Laid-Open Patent Application 54-115255.

The problem of poor adhesion between the thermosensitive recording material and the thermal head can be solved by improving the surface smoothness of the recording material in the case where a support for use in the recording material is as thin as a sheet of plain paper. In contrast to this, when the thermosensitive recording material comprising a relatively thick support material is employed, which will be hereinafter referred to as a thick thermosensitive recording material, it is impossible to improve the adhesion to the thermal head and cope with the high-speed printing operation merely by increasing the surface smoothness of the recording material. The adhesion of the conventional thick thermosensitive recording material to the thermal head is poor because the stiffness of the thick thermosensitive recording material is too large. As a result, image unevenness and blurring occur in the course of thermal printing. Thus, the conventional thick thermosensitive recording material cannot produce high quality images.

SUMMARY OF THE INVENTION

Accordingly, an object of the present invention is to provide a thick thermosensitive recording material with good adhesion to a thermal head, which is capable of producing excellent images with high image density, free from the image unevenness and blurring.

The above-mentioned object of the present invention can be achieved by a thermosensitive recording material comprising a support and a thermosensitive coloring layer formed thereon, capable of inducing color development by the application of heat thereto, with the stiffness of the recording material in the lengthwise direction thereof in accordance with JIS-P-8125 being less than $0.45\ \exp^{0.018x}$ (gf·cm) wherein x represents the thickness (μm) of the recording material measured in accordance with JIS-P-8118, provided that the lengthwise direction of the recording material is (i) a machine direction in which cellulose fiber contained in a natural material for use in the support is oriented, or (ii) a plane direction of the recording material when a synthetic material is used for the support.

In the first mentioned thermosensitive recording material, the recording material may have a thickness of 150 μm or more.

Further, in the first mentioned thermosensitive recording material the surface smoothness of the recording material may be 800 sec or more in accordance with J.TAPPI No. 5B.

DESCRIPTION OF THE PREFERRED EMBODIMENTS

It is supposed that the drawbacks of a conventional thick thermosensitive recording material result from the excessive stiffness thereof. According to the present invention, the stiffness of the thick thermosensitive recording material in the lengthwise direction thereof is less than $0.45\ \exp^{0.018x}$ (gf·cm) wherein x represents the thickness (μm) of the recording material. Therefore, the adhesion of the thick thermosensitive recording material to the thermal head can be improved, thereby obtaining high quality images with high image density, free from image unevenness and blurring.

In the present invention the stiffness of the thermosensitive recording material is measured in accordance with JIS-P-8125, and the thickness thereof, in accordance with JIS-P-8118.

When the stiffness of the recording material in the lengthwise direction thereof is measured, the lengthwise direction of the recording material means (i) a machine direction in which cellulose fiber contained in a natural material for use in the support is oriented, or (ii) a plane direction of the recording material when a synthetic material is used for the support.

In the thick thermosensitive recording material of the present invention, the recording material may have a thickness of 150 μm or more, and a surface smoothness of 800 sec or more in accordance with J.TAPPI No. 5B.

The stiffness of a support for use in the thermosensitive recording material is an important factor in determining the total stiffness of the thick thermosensitive recording material. To decrease the stiffness of the thermosensitive recording material in the lengthwise direction, therefore, it is desirable to select a material for the support with a relatively small stiffness in comparison with thickness thereof. A material with a thickness of 120 to 300 μm and a stiffness of less than 0.53 $\exp^{0.018y}$ (gf·cm), wherein y represents the thickness (μm) of the material is preferably employed for the support of the thick thermosensitive recording material according to the present invention. It is further preferable that the thickness of the support for use in the thick thermosensitive recording material of the present invention be about 130 μm or more.

When a sheet of paper is used as the support of the thick thermosensitive recording material, the support with a desired stiffness can be obtained by controlling the conditions in the process of paper-making, for example, by adjusting the amount of a loading material contained in paper and the degree of beating in the course of preparation of paper. In the present invention, a sheet of paper with a basis weight of 100 to 250 g/m$^2$ is preferably used as the support of the recording material. With the same thickness, a sheet of paper with high density is preferred.

In addition, a plastic film or a sheet of synthetic paper can be used as the support for use in the thermosensitive recording material of the present invention. Particularly, the synthetic paper comprising as the main component polyethylene, polypropylene, polystyrene or polyvinyl chloride is preferred. In the case of the plastic film, a film of low-density polyethylene, flexible polyvinyl chloride or polyvinylidene chloride, which has a relatively small modulus of elasticity in tension, is preferred in the present invention.

Even though the stiffness of a material for use in the support is originally large, the stiffness of the support can be decreased by subjecting the support to calendering. This method is effective especially when a sheet of paper is employed as the support. This is because that the density of paper can be increased by calendering, thereby decreasing the stiffness of a sheet of paper.

It is known that the thermosensitive recording material is subjected to calendering to obtain a desired surface smoothness after formation of the thermosensitive coloring layer on the support. Furthermore, it is possible to decrease the stiffness of the thermosensitive recording material by such calendering process. In this case, there is a risk of causing the fogging of the background of the recording material by the calendering depending upon the loading conditions in the process of calendering. When the thermosensitive coloring layer is subjected to calendering, therefore, it is preferable that the load applied to the recording material be as small as possible.

In general, after the formation of the thermosensitive coloring layer, the thermosensitive recording material is subjected to moisture conditioning to such a degree that the water content of the recording material is within the range of 4 to 6%. To decrease the stiffness as previously specified in the present invention, the water content of the recording material may be conditioned to 6 to 8%. More specifically, the water content can be adjusted to 6 to 8% by lowering the drying temperature or curtailing the drying time in the course of formation of the thermosensitive coloring layer.

The method for decreasing the stiffness of the thick thermosensitive recording material is not limited to the above-mentioned embodiments.

The thermosensitive recording material according to the present invention comprises the support such as a sheet of paper or synthetic paper, or a plastic film, and the thermosensitive coloring layer formed on the support, comprising as the main component a thermosensitive coloring composition. The thermosensitive coloring composition for use in the thermosensitive coloring layer comprises a coloring agent such as a leuco dye and a color developer capable of inducing color formation in the coloring agent upon the application of heat thereto. In addition to the above, a binder agent is appropriately contained in the thermosensitive coloring layer for binding the above-mentioned leuco dye and color developer to the support of the thermosensitive recording material of the present invention.

Any leuco dyes used in conventional thermosensitive recording materials can be employed as the coloring agents in the thermosensitive coloring layer. Specifically, triphenylmethane leuco compounds, fluoran leuco compounds, phenothiazine leuco compounds, auramine leuco compounds, spiropyran leuco compounds, and indolinophthalide leuco compounds are preferably employed in the thermosensitive coloring layer.

Various electron acceptor compounds capable of inducing color formation in the above-mentioned leuco dyes under application of heat thereto when coming in contact with the leuco dyes are used as the color developers for use in the thermosensitive coloring layer. For example, phenolic compounds, thiophenolic compounds, thiourea derivatives, and organic acids and metal salts thereof, are preferably employed.

A variety of binder agents used in the conventional thermosensitive recording materials can be employed as the binder agents for use in the thermosensitive coloring layer. Specific examples of the binder agent are water soluble polymers such as polyvinyl alcohol, starch and starch derivatives, cellulose derivatives, and sodium polyacrylate; and polyacrylic acid ester.

Moreover, in the present invention, a variety of thermofusible materials serving as thermosensitivity-improving agents, and auxiliary additive components such as a filler and a surface active agent which are used in the conventional thermosensitive recording materials, can be employed together with the leuco dye and the color developer in the thermosensitive coloring layer.

When necessary, an intermediate layer may be interposed between the support and the thermosensitive coloring layer, and/or a protective layer may be provided on the thermosensitive coloring layer. Further, for instance, when the recording material is applied to a ticket, a magnetic recording layer may be provided in the thermosensitive recording material.

Other features of this invention will become apparent in the course of the following description of exemplary embodiments, which are given for illustration of the invention and are not intended to be limiting thereof.

EXAMPLE 1

(Formation of Thermosensitive Coloring Layer)

The following components were separately pulverized and dispersed in a sand grinder for 2 to 4 hours, so that a liquid A and a liquid B were prepared:

| | Parts by Weight |
|---|---|
| [Liquid A] | |
| 3-(N-methyl-N-cyclohexyl)amino-6-methyl-7-anilinofluoran | 10 |
| 10% aqueous solution of polyvinyl alcohol | 10 |
| Water | 80 |
| [Liquid B] | |
| Benzyl p-hydroxybenzoate | 10 |
| Calcium carbonate | 10 |
| 2,2'-methylenebis(4-methyl-6-tert-butylphenol) | 5 |
| 10% aqueous solution of polyvinyl alcohol | 20 |
| Water | 55 |

The liquid A and the liquid B were mixed with stirring at a weight ratio of 1:3, so that a coating liquid for a thermosensitive coloring layer was obtained. The thermosensitive coloring layer coating liquid was coated on a sheet of paper with a thickness of 240 μm and a stiffness of 45 gf·cm in a deposition amount of 5.4 to 5.6 g/m$^2$ on a dry basis by use of a labocoating rod, and then dried. Thus, a thermosensitive coloring layer was formed on the support.

(Formation of Protective Layer)

A mixture of the following components was stirred and dispersed, so that a coating liquid for a protective layer was prepared:

| | Parts by Weight |
|---|---|
| 10% aqueous solution of polyvinyl alcohol | 50 |
| Calcium carbonate | 2.5 |
| Zinc stearate | 0.2 |
| Water | 47.3 |

The thus prepared protective layer coating liquid was coated on the above prepared thermosensitive coloring layer in a deposition amount of 5 g/m$^2$ on a dry basis, and then dried, so that a protective layer was formed on the thermosensitive coloring layer.

Then, the surface of the protective layer was subjected to calendering six times by use of a minicalender (made by Yuriroll Machine Co., Ltd.) with the application of a load of 30 kgf/cm$^2$.

Thus, a thermosensitive recording material No. 1 according to the present invention was prepared.

The thickness, the stiffness and the surface smoothness of the obtained thermosensitive recording material are shown in Table 1.

EXAMPLE 2

The same thermosensitive coloring layer and protective layer were formed on the same support as in Example 1.

Then, the surface of the protective layer was subjected to calendering twice by use of a minicalender (made by Yuriroll Machine Co., Ltd.) with the application of a load of 30 kgf/cm$^2$.

Thereafter, the above prepared recording material was placed under the conditions that the temperature was 40° C. and the relative humidity was 90% to adjust the water content of the recording material to 8%.

Thus, a thermosensitive recording material No. 2 according to the present invention was prepared.

The thickness, the stiffness and the surface smoothness of the obtained thermosensitive recording material are shown in Table 1.

EXAMPLE 3

The same thermosensitive coloring layer and protective layer were formed on the same support as in Example 1.

Then, the above prepared recording material was placed under the conditions that the temperature was 40° C. and the relative humidity was 90% to adjust the water content of the recording material to 8%.

Thus, a thermosensitive recording material No. 3 according to the present invention was prepared.

The thickness, the stiffness and the surface smoothness of the obtained thermosensitive recording material are shown in Table 1.

Comparative Example 1

The same thermosensitive coloring layer and protective layer were formed on the same support as in Example 1.

Then, the surface of the protective layer was subjected to calendering twice by use of a minicalender (made by Yuriroll Machine Co., Ltd.) with the application of a load of 30 kgf/cm$^2$.

Thus, a comparative thermosensitive recording material No. 1 was prepared.

The thickness, the stiffness and the surface smoothness of the obtained thermosensitive recording material are shown in Table 1.

EXAMPLE 4

The procedure for preparation of the comparative thermosensitive recording material No. 1 in Comparative Example 1 was repeated except that a sheet of paper serving as the support employed in Comparative Example 1 was subjected to calendering four times by use of a minicalender (made by Yuriroll Machine Co., Ltd.) with the application of a load of 30 kgf/cm$^2$ before the formation of the thermosensitive coloring layer thereon.

Thus, a thermosensitive recording material No. 4 according to the present invention was prepared.

The thickness, the stiffness and the surface smoothness of the obtained thermosensitive recording material are shown in Table 1.

EXAMPLE 5

The procedure for preparation of the comparative thermosensitive recording material No. 1 in Comparative Example 1 was repeated except that a sheet of paper serving as the support employed in Comparative Example 1 was changed to a sheet of paper with a thickness of 240 μm and a stiffness of 36 gf·cm.

Thus, a thermosensitive recording material No. 5 according to the present invention was prepared.

The thickness, the stiffness and the surface smoothness of the obtained thermosensitive recording material are shown in Table 1.

Images were thermally recorded on each of the thermosensitive recording materials Nos. 1 to 5 according to the present invention and the comparative thermosensitive recording material No. 1, using a commercially available thermal label printer for laboratory use, equipped with a thermal head, made by Kyocera Corp. The images thus printed on each thermosensitive recording material were evaluated by visual observation from the viewpoints of image unevenness and image blurring. The results are shown in the following Table 1.

TABLE 1

| | Thickness of Thermosensitive Recording Material (μm) | Stiffness of Recording Material (gf · cm) | Surface Smoothness (sec) | Image Quality (*) |
|---|---|---|---|---|
| Ex. 1 | 245 | 35 | 1500 | ⊙ |
| Ex. 2 | 250 | 38 | 850 | ⊙ |
| Ex. 3 | 247 | 38 | 300 | o |
| Ex. 4 | 244 | 36 | 1000 | ⊙ |
| Ex. 5 | 250 | 37 | 1100 | ⊙ |
| Comp. Ex. 1 | 250 | 42 | 900 | x |

(*) Image Quality
⊙: Excellent (Neither blurring nor unevenness was observed in obtained images.)
o: Good (Image blurring and unevenness were slightly observed, but they did not cause any problem for use in practice.)
x: Poor (Image blurring and unevenness were considerably observed.)

As is apparent from the results in Table 1, high quality images free from the image unevenness and blurring can be formed on the thick thermosensitive recording materials of the present invention. Since the stiffness of the thermosensitive recording material of the present invention is less than $0.45 \exp^{0.018x}$ (gf·cm) wherein x represents the thickness (μm) of the recording material, the adhesion of the thick thermosensitive recording material of the present invention to the thermal head can be improved.

Further, when the surface smoothness of the thermosensitive recording material is adjusted to 800 sec or more, the adhesion of the recording material to the thermal head is further improved.

EXAMPLE 6

(Formation of Thermosensitive Coloring Layer)

The following components were separately pulverized and dispersed in a sand grinder for 2 to 4 hours, so that a liquid A and a liquid B were prepared:

| | Parts by Weight |
|---|---|
| [Liquid A] | |
| 3-(N-methyl-N-cyclohexyl)amino-6-methyl-7-anilinofluoran | 10 |
| 10% aqueous solution of polyvinyl alcohol | 10 |
| Water | 80 |
| [Liquid B] | |
| Benzyl p-hydroxybenzoate | 10 |
| Calcium carbonate | 10 |
| 2,2'-methylenebis(4-methyl-6-tert-butylphenol) | 5 |
| 10% aqueous solution of polyvinyl alcohol | 20 |
| Water | 55 |

The liquid A and the liquid B were mixed with stirring at a weight ratio of 1:3, so that a coating liquid for a thermosensitive coloring layer was obtained. The thermosensitive coloring layer coating liquid was coated on a sheet of commercially available paper (made by Chuetsu Pulp Industry Co., Ltd.) with a thickness of 256 μm and a stiffness of 38 gf·cm in a deposition amount of 5.5 g/m$^2$ on a dry basis by use of a labocoating rod, and then dried. Thus, a thermosensitive coloring layer was formed on the support.

(Formation of Protective Layer)

A mixture of the following components was stirred and dispersed, so that a coating liquid for a protective layer was prepared:

| | Parts by Weight |
|---|---|
| 10% aqueous solution of polyvinyl alcohol | 50 |
| Calcium carbonate | 2.5 |
| Zinc stearate | 0.2 |
| Water | 47.3 |

The thus prepared protective layer coating liquid was coated on the above prepared thermosensitive coloring layer in a deposition amount of 5 g/m$^2$ on a dry basis, and then dried, so that a protective layer was formed on the thermosensitive coloring layer.

Then, the surface of the protective layer was subjected to calendering twice by use of a minicalender (made by Yuriroll Machine Co., Ltd.) with the application of a load of 20 kgf/cm$^2$. Thus, a thermosensitive recording material No. 6 according to the present invention was prepared.

The thickness and the stiffness of the obtained thermosensitive recording material are shown in Table 2.

EXAMPLE 7

A sheet of commercially available paper (made by Shinfuji Paper Co., Ltd.) with a thickness of 266 μm and a stiffness of 65 gf·cm was subjected to calendering four times by use of a minicalender (made by Yuri Roll Machine Co., Ltd.), with the application of a load of 30 kgf/cm$^2$, so that a support with a thickness of 234 μm and a stiffness of 30 gf·cm was obtained.

After completion of the calendering of the support, the same thermosensitive coloring layer and protective layer as employed in Example 6 were successively formed on the above-prepared support. Thus, a thermosensitive recording material No. 7 according to the present invention was prepared.

The thickness and the stiffness of the obtained thermosensitive recording material are shown in Table 2.

EXAMPLE 8

The same thermosensitive coloring layer and protective layer as in Example 6 were formed on a sheet of commercially available paper (made by Shinfuji Paper Co., Ltd.) with a thickness of 266 μm and a stiffness of 65 gf·cm.

Then, the surface of the thus prepared protective layer was subjected to calendering eight times by use of a minicalender, made by Yuri Roll Machine Co., Ltd., with the application of a load of 20 kgf/cm$^2$. Thus, a thermosensitive recording material No. 8 according to the present invention was prepared.

The thickness and the stiffness of the obtained thermosensitive recording material are shown in Table 2.

Comparative Example 2

The procedure for preparation of the thermosensitive recording material No. 6 in Example 6 was repeated except that a sheet of paper serving as the support employed in Example 6 was replaced by a sheet of commercially available paper (made by Shinfuji Paper Co., Ltd.) with a thickness of 266 μm and a stiffness of 65 gf·cm.

Thus, a comparative thermosensitive recording material No. 2 was prepared.

The thickness and the stiffness of the obtained thermosensitive recording material are shown in Table 2.

Comparative Example 3

The procedure for preparation of the thermosensitive recording material No. 6 in Example 6 was repeated except that a sheet of paper serving as the support employed in Example 6 was replaced by a sheet of commercially available paper (made by Daishowa Paper Manufacturing Co., Ltd.) with a thickness of 232 μm and a stiffness of 46 gf·cm.

Thus, a comparative thermosensitive recording material No. 3 was prepared.

The thickness and the stiffness of the obtained thermosensitive recording material are shown in Table 2.

EXAMPLE 9

The procedure for preparation of the thermosensitive recording material No. 6 in Example 6 was repeated except that the formulations for the coating liquid A and the coating liquid B used for preparation of the thermosensitive coloring layer coating liquid in Example 6 were respectively replaced by those for a coating liquid C and a coating liquid D, so that a thermosensitive recording material No. 9 according to the present invention was prepared.

| | Parts by Weight |
|---|---|
| [Liquid C] | |
| 3-dibutylamino-6-methyl-7-anilinofluoran | 10 |
| 10% aqueous solution of polyvinyl alcohol | 10 |
| Water | 80 |
| [Liquid D] | |
| 4-hydroxy-4'-isopropoxydiphenyl sulfone | 15 |
| Calcium carbonate | 10 |
| 10% aqueous solution of polyvinyl alcohol | 20 |
| Water | 55 |

The thickness and the stiffness of the obtained thermosensitive recording material are shown in Table 2.

EXAMPLE 10

The procedure for preparation of the thermosensitive recording material No. 7 in Example 7 was repeated except that the formulations for the coating liquid A and the coating liquid B used for preparation of the thermosensitive coloring layer coating liquid in Example 7 were respectively replaced by those for the above-mentioned coating liquid C and coating liquid D, so that a thermosensitive recording material No. 10 according to the present invention was prepared.

The thickness and the stiffness of the obtained thermosensitive recording material are shown in Table 2.

EXAMPLE 11

The procedure for preparation of the thermosensitive recording material No. 8 in Example 8 was repeated except that the formulations for the coating liquid A and the coating liquid B used for preparation of the thermosensitive coloring layer coating liquid in Example 8 were respectively replaced by those for the above-mentioned coating liquid C and coating liquid D, so that a thermosensitive recording material No. 11 according to the present invention was prepared.

The thickness and the stiffness of the obtained thermosensitive recording material are shown in Table 2.

Comparative Example 4

The procedure for preparation of the comparative thermosensitive recording material No. 2 in Comparative Example 2 was repeated except that the formulations for the coating liquid A and the coating liquid B used for preparation of the thermosensitive coloring layer coating liquid in Comparative Example 2 were respectively replaced by those for the above-mentioned coating liquid C and coating liquid D, so that a comparative thermosensitive recording material No. 4 was prepared.

The thickness and the stiffness of the obtained thermosensitive recording material are shown in Table 2.

Comparative Example 5

The procedure for preparation of the comparative thermosensitive recording material No. 3 in Comparative Example 3 was repeated except that the formulations for the coating liquid A and the coating liquid B used for preparation of the thermosensitive coloring layer coating liquid in Comparative Example 3 were respectively replaced by those for the above-mentioned coating liquid C and coating liquid D, so that a comparative thermosensitive recording material No. 5 was prepared.

The thickness and the stiffness of the obtained thermosensitive recording material are shown in Table 2.

Each of the thermosensitive recording materials Nos. 6 to 11 according to the present invention and the comparative thermosensitive recording materials Nos. 2 to 5 was subjected to a printing test, using a commercially available thermal printing test apparatus including a thin-film thermal head made by Matsushita Electronic Components Co., Ltd. The printing test was carried out under the conditions that the recording speed was 4 msec/line, the scanning line density was 8×7.7 dot/mm, and the electric power applied to the thermal head was 0.45 W/dot, with the pulse width being increased from 0.2 to 0.9 msec.

The images thus printed on each thermosensitive recording material were evaluated by visual observation from the viewpoints of image unevenness and image blurring. The results are shown in the following Table

TABLE 2

| | Thickness of Thermosensitive Recording Material (μm) | Stiffness of Recording Material (gf · cm) | Image Quality (*) |
|---|---|---|---|
| Ex. 6 | 261 | 36 | o |
| Ex. 7 | 239 | 26 | o |
| Ex. 8 | 234 | 23 | o |
| Ex. 9 | 262 | 36 | o |
| Ex.10 | 238 | 27 | o |
| Ex.11 | 236 | 24 | o |
| Comp. Ex. 2 | 270 | 62 | x |
| Comp. Ex. 3 | 240 | 41 | Δ |
| Comp. Ex. 4 | 269 | 60 | x |
| Comp. Ex. 5 | 238 | 40 | Δ |

(*) Image Quality
o: Good (Neither blurring nor unevenness was observed in obtained images.)

Δ: Slightly poor (Image blurring and unevenness were slightly observed.)
x: Very poor (Image blurring and unevenness were considerably observed.)

As is apparent from the results in Table 2, high quality images free from the image unevenness and blurring can be formed on the thick thermosensitive recording materials of the present invention. Since the stiffness of the thermosensitive recording material of the present invention is less than 0.45 $\exp^{0.018x}$ (gf·cm) wherein x represents the thickness (μm) of the recording material, the adhesion of the thick thermosensitive recording material of the present invention to the thermal head can be improved.

What is claimed is:

1. A thermosensitive recording material comprising a support and a thermosensitive coloring layer formed on said support, capable of inducing color development by the application of heat thereto, with the stiffness of said thermosensitive recording material in the lengthwise direction thereof in accordance with JIS-P-8125 being less than 0.45 $\exp^{0.018x}$ (gf·cm) wherein x represents the thickness (μm) of said recording material measured in accordance with JIS-P-8118, provided that said lengthwise direction of said recording material is (i) a machine direction in which cellulose fiber contained in a natural material for use in said support is oriented, or (ii) a plane direction of said recording material when a synthetic material is used for said support.

2. The thermosensitive recording material as claimed in claim 1, wherein said thermosensitive recording material has a thickness of 150 μm or more.

3. The thermosensitive recording material as claimed in claim 1, wherein said thermosensitive recording material has a surface smoothness of 800 sec or more in accordance with J. TAPPI No. 5B.

* * * * *